US011808092B2

(12) United States Patent
King et al.

(10) Patent No.: US 11,808,092 B2
(45) Date of Patent: Nov. 7, 2023

(54) ELECTRO-MECHANICAL RELEASE TOOL AND ASSOCIATED METHODS

(71) Applicant: KING SOUTHWEST & CONSULTING OF CYPRESS, Houston, TX (US)

(72) Inventors: George R. King, Houston, TX (US); Santos D. Ortiz, Houston, TX (US)

(73) Assignee: KING SOUTHWEST & CONSULTING OF CYPRESS, Houston, TX (US)

( * ) Notice: Subject to any disclaimer, the term of this patent is extended or adjusted under 35 U.S.C. 154(b) by 69 days.

(21) Appl. No.: 17/620,252

(22) PCT Filed: Jul. 6, 2020

(86) PCT No.: PCT/US2020/040862

§ 371 (c)(1),
(2) Date: Dec. 17, 2021

(87) PCT Pub. No.: WO2021/021390

PCT Pub. Date: Feb. 4, 2021

(65) Prior Publication Data

US 2022/0341271 A1 Oct. 27, 2022

Related U.S. Application Data

(60) Provisional application No. 62/879,070, filed on Jul. 26, 2019.

(51) Int. Cl.

| | |
|---|---|
| ***E21B 17/02*** | (2006.01) |
| ***E21B 17/06*** | (2006.01) |
| ***E21B 43/119*** | (2006.01) |

(52) U.S. Cl.

CPC ..... *E21B 17/021* (2013.01); *E21B 17/06* (2013.01); *E21B 43/1193* (2020.05)

(58) Field of Classification Search

CPC ..... E21B 17/021; E21B 17/06; E21B 43/1193

See application file for complete search history.

(56) References Cited

U.S. PATENT DOCUMENTS 3,638,723 A 2/1972 Carroll
4,971,153 A * 11/1990 Rowe ..... E21B 47/06 166/387

(Continued)

FOREIGN PATENT DOCUMENTS

WO 2010061231 A1 6/2010
WO 2018112153 A1 6/2018

OTHER PUBLICATIONS

International Search Report with Written Opinion dated Oct. 15, 2020 for PCT Patent Application No. PCT/US2020/040862, 12 pages.

(Continued)

*Primary Examiner* — Jonathan Malikasim
(74) *Attorney, Agent, or Firm* — Smith IP Services, P.C.

(57) ABSTRACT

A release tool can include an inner mandrel, an electric motor assembly, and an engagement member. The inner mandrel is displaceable by the electric motor assembly between a position in which the inner mandrel supports the engagement member and prevents separation of portions of the release tool, and another position in which the engagement member is not supported by the inner mandrel and separation of the portions of the release tool is permitted. A method of separating portions of a release tool in a well can include transmitting an electrical signal to an electrical motor assembly of the release tool, displacing an inner mandrel of the release tool in response to the transmitting, and separating the portions of the release tool after the displacing.

18 Claims, 5 Drawing Sheets

(56) References Cited

U.S. PATENT DOCUMENTS

| | | | | |
|---|---|---|---|---|
| 8,230,932 | B2 * | 7/2012 | Ratcliffe | E21B 17/028 166/301 |
| 9,938,789 | B2 * | 4/2018 | Silva | E21B 43/27 |
| 11,136,866 | B2 * | 10/2021 | Holodnak | E21B 23/14 |
| 2004/0134667 | A1 | 7/2004 | Brewer et al. | |
| 2005/0230115 | A1 | 10/2005 | Rose | |
| 2007/0023191 | A1 | 2/2007 | Dreggevik | |
| 2012/0132439 | A1 | 5/2012 | Ratcliffe et al. | |
| 2013/0014934 | A1 | 1/2013 | MacRae et al. | |
| 2013/0161965 | A1 | 6/2013 | Yajure | |

OTHER PUBLICATIONS

Office Action dated Dec. 21, 2020 for U.S. Appl. No. 16/719,401, 23 pages.
Office Action dated Mar. 26, 2021 for U.S. Appl. No. 16/719,401, 16 pages.

* cited by examiner

ELECTRO-MECHANICAL RELEASE TOOL AND ASSOCIATED METHODS

CROSS-REFERENCE TO RELATED APPLICATIONS

This application is a national stage under 35 USC 371 of International Application No. PCT/US20/40862 filed on 6 Jul. 2020, which claims the benefit of the filing date of U.S. Provisional Application No. 62/879,070 filed on 26 Jul. 2019. The entire disclosures of these prior applications are incorporated herein by this reference.

TECHNICAL FIELD

This disclosure relates generally to equipment utilized and operations performed in conjunction with a subterranean well and, in one example described below, more particularly provides an electro-mechanical release tool and associated methods.

BACKGROUND

It can be advantageous to be able to disconnect upper and lower sections of a bottom hole assembly in a wellbore, for example, so that the upper section can be retrieved from the wellbore along with a conveyance used to transport the bottom hole assembly through the wellbore. The lower section can be retrieved later, such as, with a fishing operation.

It will, thus, be appreciated that improvements are continually needed in the arts of designing, constructing and operating well tools which are capable of reliably and conveniently disconnecting upper and lower sections of a bottom hole assembly. Such improvements may be useful in a variety of different well configurations, and with a variety of different bottom hole assembly configurations.

DETAILED DESCRIPTION

Figure 1:
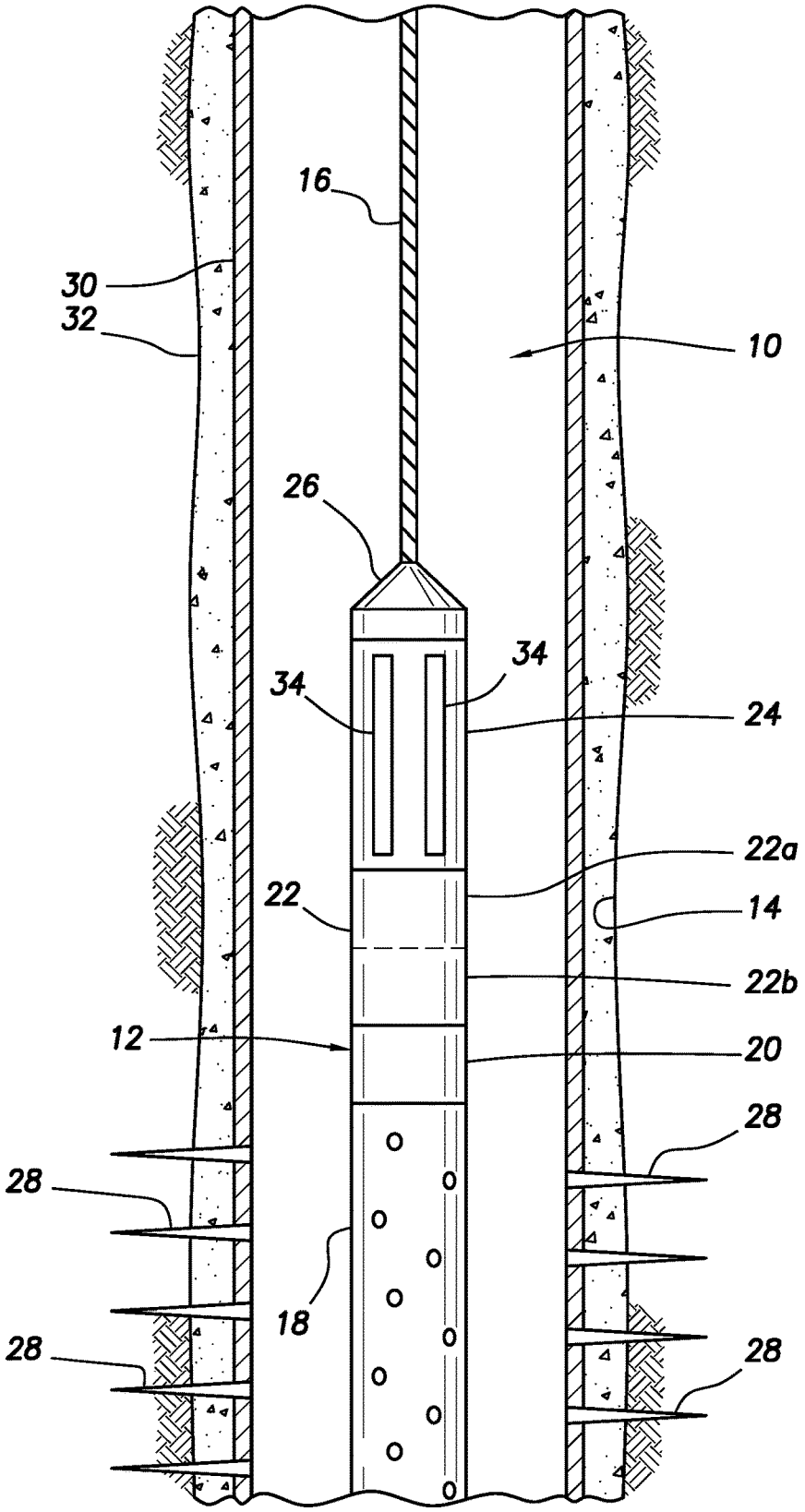
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly 12 is conveyed through a wellbore 14 by means of a conveyance 16. The conveyance 16 in this example is a wireline, slickline or "e-line" of the type including at least one electrical conductor for providing power and communication between a surface control system and the bottom hole assembly 12. In other examples, the conveyance 16 could be a coiled tubing string or another type of tubular string.

Note that it is not necessary for an electrical conductor to be provided for supplying power and communication between the surface and the bottom hole assembly 12. For example, a battery or a downhole electrical generator could be used to supply power to the bottom hole assembly 12, and/or various forms of telemetry (e.g., acoustic, electromagnetic, RFID, etc.) may be used for communication between the surface and the bottom hole assembly.

As depicted in FIG. 1, the bottom hole assembly 12 includes a perforator 18, a firing head 20, an electro-mechanical release tool 22, an instrument carrier 24 and an upper connection 26. In other examples, different components, different combinations of components and different configurations of components may be used in the bottom hole assembly 12. Thus, the scope of this disclosure is not limited to any particular components or arrangement of components in the bottom hole assembly 12.

The perforator 18 of FIG. 1 is of the type known to those skilled in the art as an explosive jet-type perforator. The perforator 18 includes multiple explosive shaped charges that, when detonated, form perforations 28 extending through casing 30 and cement 32 lining the wellbore 14. Other types of perforators (such as, abrasive jet perforators, drill perforators, etc.) may be used in other examples, and it is not necessary for the bottom hole assembly 12 to include the perforator 18.

The firing head 20 is used to initiate detonation of the shaped charges in the perforator 18. The firing head 20 may actuate the perforator 18 in response to a signal transmitted from the surface via an electrical conductor or telemetry, or in response to another stimulus. If the perforator 18 does not include explosive shaped charges, or if the perforator is not used in the bottom hole assembly 12, then the firing head 20 may not be used.

The release tool 22 enables the perforator 18 and firing head 20 (and any other components of the bottom hole assembly 12 connected below the perforator) to be disconnected from an upper section of the bottom hole assembly and the conveyance 16. This will allow the upper section of the bottom hole assembly 12 to be retrieved from the wellbore 14 apart from the lower section of the bottom hole assembly, for example, in the event that the lower section becomes stuck in the wellbore.

In the FIG. 1 example, the release tool 22 is operable in response to a signal transmitted from the surface via the electrical conductor of the conveyance 16. When the release tool 22 is actuated, an upper portion 22*a* of the release tool can be disconnected from a lower portion 22*b* of the release tool.

The instrument carrier 24 transports instruments 34 (such as, pressure and temperature gauges, vibration or shock sensors, or other types of sensors) in the bottom hole assembly 12. Such instruments 34 can be relatively delicate and sensitive to shock due to detonation of the shaped charges in the perforator 18. In the FIG. 1 example, however, the release tool 22 is capable of damping the shock produced when the perforator 18 is fired, so that the instruments 34 are protected from the shock.

In some examples, the instruments 34 could be incorporated into the release tool 22. The instruments 34 could, for example, be positioned in or adjacent a motor section 54 (see FIG. 2B) of the release tool 22, at which location shock should be at a minimum level. It is contemplated that shock will be less severe within the release tool 22 than above the release tool, but that shock above the release tool will be less severe than shock experienced below the release tool.

Note that, in the FIG. 1 example, the release tool 22 is connected in the bottom hole assembly 12 between the perforator 18 and the instrument carrier 24. If the instrument carrier 24 is used in the bottom hole assembly 12 without the perforator 18, then it may be desirable to position the release tool 22 above the instrument carrier. Thus, the scope of this disclosure is not limited to any particular position of the release tool 22 relative to any other component(s) of the bottom hole assembly 12.

Figure 2A:
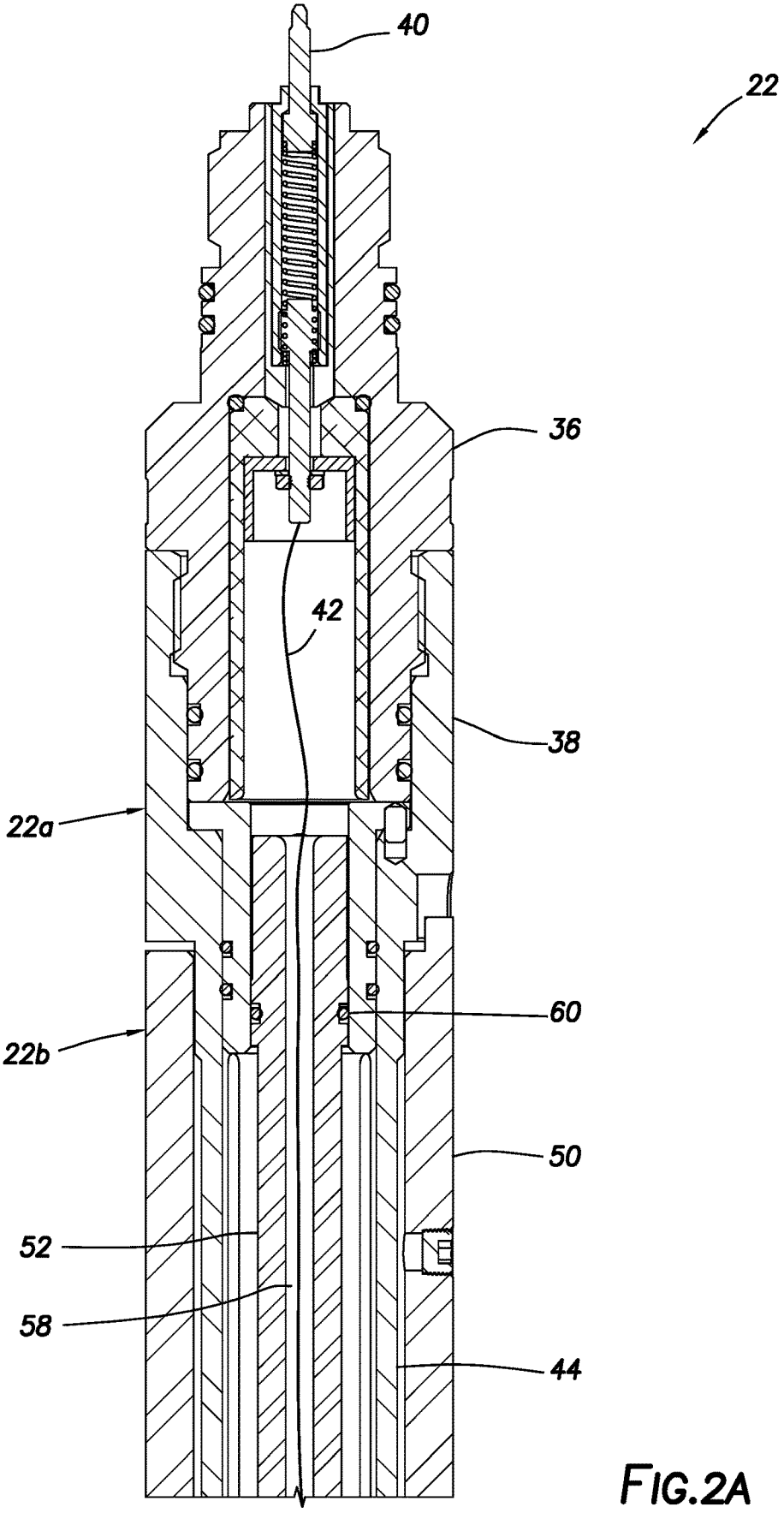
FIGS. 2A-C are representative cross-sectional views of an example of an electro-mechanical release tool that can embody the principles of this disclosure.
Figure 2B:
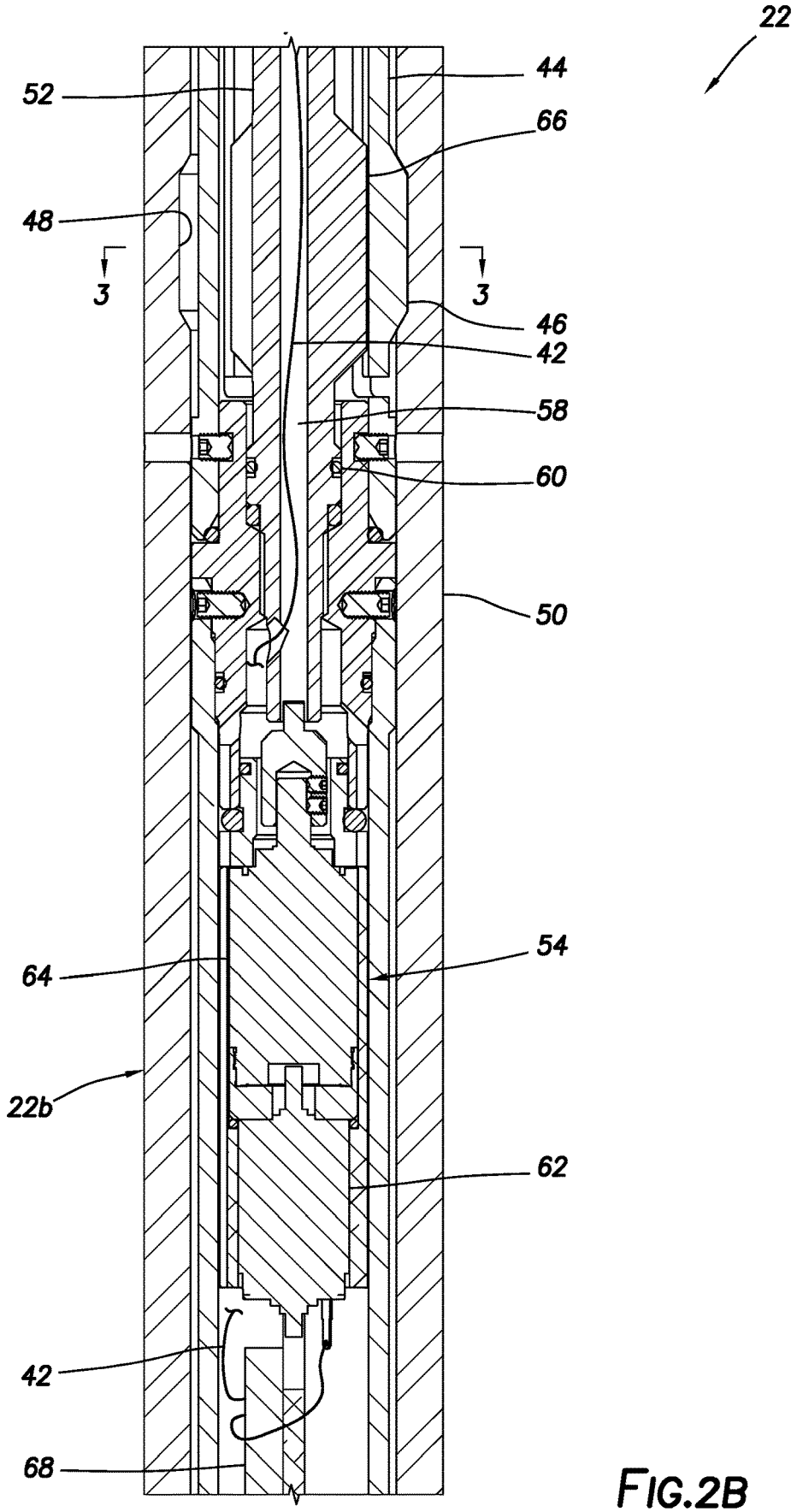
Figure 2C:
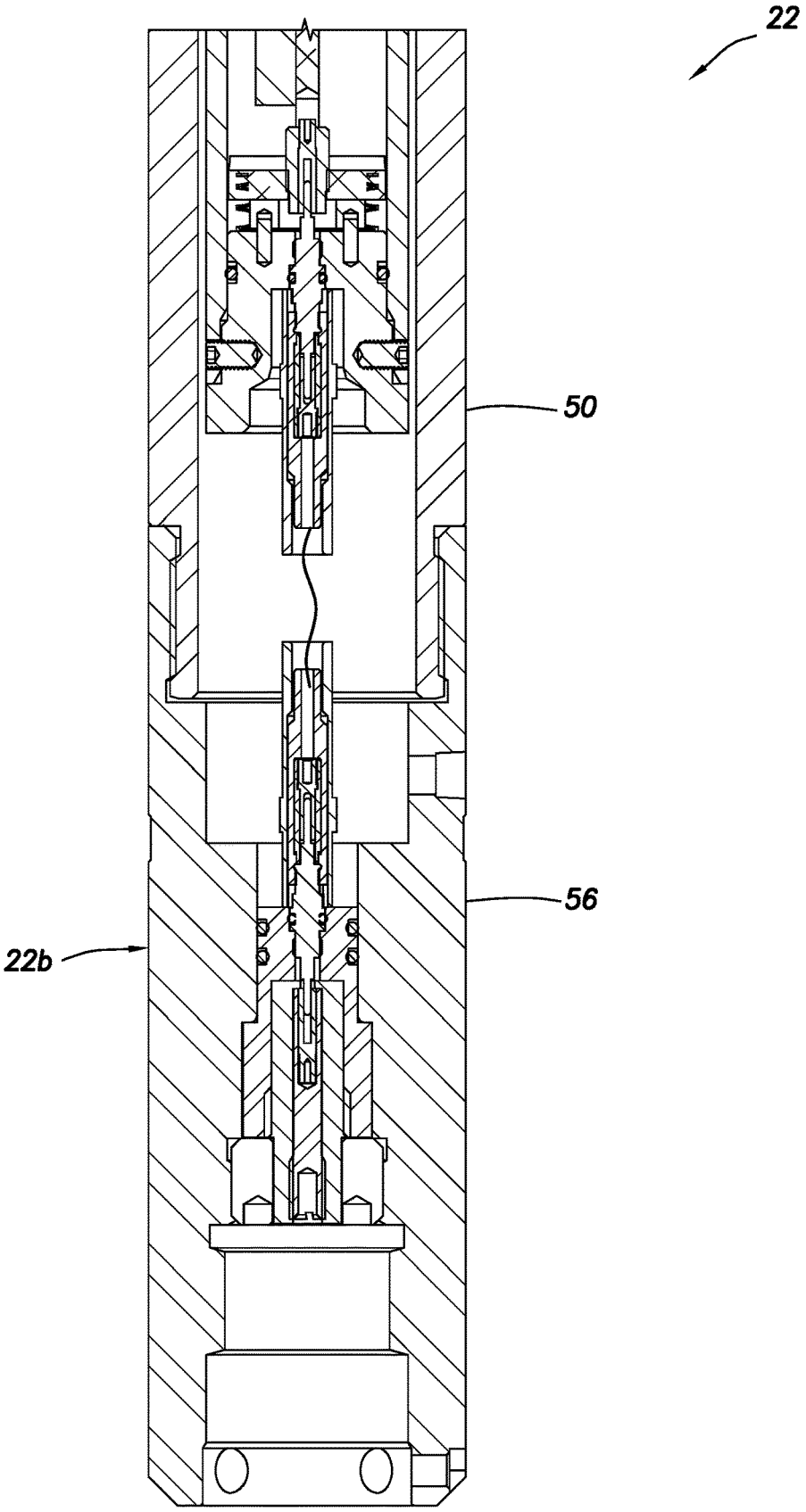

Referring additionally now to FIGS. 2A-C, cross-sectional views of a more detailed example of the release tool 22 is representatively illustrated. The FIGS. 2A-C release tool 22 may be used in the system 10 and method of FIG. 1, or it may be used with other systems and methods.

In the FIGS. 2A-C example, the upper portion 22*a* of the release tool 22 includes a top sub 36 and a collet sub 38. The top sub 36 provides for connecting the release tool 22 to components (such as the instrument carrier 24 or the upper connector 26) above the release tool 22.

An electrical connector 40 connects to the electrical conductor in the conveyance 16, via the instrument carrier 24 or any other components connected between the conveyance and the release tool 22. In this manner, an electrical conductor 42 of the release tool 22 is in electrical communication with the conductor of the conveyance 16. If, however, the release tool 22 is provided with electrical power via batteries or a generator, the electrical connector 40 may not be used.

The collet sub 38 includes downwardly extending and circumferentially spaced apart flexible collets 44 having radially enlarged engagement members 46. The engagement members 46 are radially outwardly engaged with a radially enlarged recess or profile 48 formed in an outer generally tubular body 50 of the lower portion 22*b*.

The lower portion 22*b* of the release tool 22 includes the body 50, an inner mandrel 52, an electric motor assembly 54 and a lower connector 56. The lower connector 56 mechanically and electrically connects the release tool 22 to components of the bottom hole assembly 12 below the release tool (such as the firing head 20 and perforator 18).

The inner mandrel 52 includes an inner passage 58 extending longitudinally through most of the inner mandrel, so that the conductor 42 can extend through the passage from the upper connector 36 to the electric motor assembly 54. Seals 60 are provided on opposite ends of the inner mandrel 52 to isolate the passage 58 from well fluids and pressures.

The electric motor assembly 54 includes an electric motor 62, a gearbox 64 and a motor controller 68. The motor controller 68 is electrically connected to the conductor 42, so that when an appropriate electrical signal is transmitted via the conductor 42, the motor controller 68 actuates the motor 62 to produce rotation of an output shaft connected to an input shaft of the gearbox 64. The motor controller 68 may include a hardware or software "switch" that supplies electrical power to the motor 62 when the appropriate electrical signal is received via the conductor 42.

An output shaft of the gearbox 64 is connected to the inner mandrel 52. Thus, when the motor 62 is supplied with an appropriate electrical signal, the motor rotates, the gearbox 64 reduces an output speed and increases an output torque of the motor, and the inner mandrel 52 is thereby rotated.

The inner mandrel 52 has multiple circumferentially spaced apart radially enlarged lobes 66 formed thereon. As depicted in FIG. 2B, the lobes 66 are radially aligned with and radially outwardly support the collet engagement members 46 in engagement with the profile 48 in the outer body 50. Thus, the outer body 50 and the remainder of the lower portion 22*b* of the release tool 22 is prevented from separating from the collet sub 38 and the remainder of the upper portion 22*a* of the release tool.

However, when the inner mandrel 52 is rotated by the motor assembly 54, the lobes 66 will no longer be radially aligned with the engagement members 46 of the collets 44. At that point, the lobes 66 will no longer radially outwardly support the collet engagement members 46 in engagement with the profile 48 in the outer body 50, and the upper and lower portions 22*a,b* of the release tool 22 will then be able to separate from each other.

In other examples, the inner mandrel 52 could be longitudinally displaced, so that the lobes 66 are no longer longitudinally aligned with the engagement members 46 of the collets 44. In this manner, the lobes 66 will no longer radially outwardly support the collet engagement members 46 in engagement with the profile 48 in the outer body 50, and the upper and lower portions 22*a,b* of the release tool 22 will then be able to separate from each other. The inner mandrel 52 can be displaced in any direction electromechanically (as in the example of the electric motor assembly 54), or hydrostatically (e.g., using a piston drive and well pressure).

Figure 3:
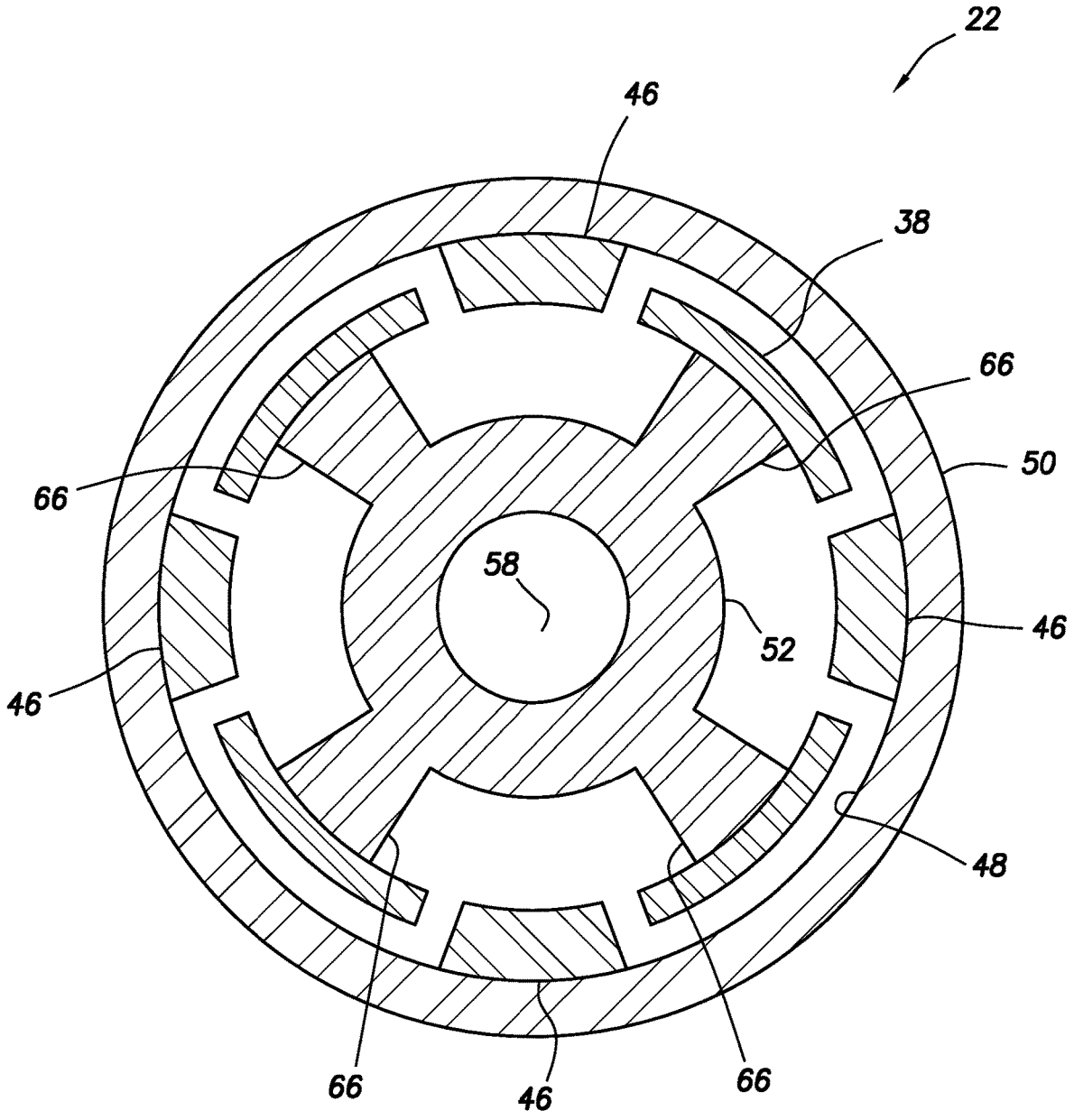
FIG. 3 is a representative cross-sectional view of the release tool in an actuated configuration, taken along line 3-3 of FIG. 2B.

Referring additionally now to FIG. 3, a cross-sectional view of the release tool 22, taken along line 3-3 of FIG. 2B is representatively illustrated. In this view, the manner in which the inner mandrel 52 can be rotated relative to the collet sub 38, so that the upper and lower portions 22*a,b* of the release tool 22 are either secured to each other or released from each other can be more clearly seen.

As depicted in FIG. 3, the inner mandrel 52 has been rotated relative to the collet sub 38, so that the lobes 66 on the inner mandrel are no longer radially aligned with the engagement members 46 of the collets 44. The lobes 66 no longer support the engagement members 46 in engagement with the profile 48. The collets 44 can flex radially inward out of engagement with the profile 48, so that the upper connector 36 and collet sub 38 can be withdrawn from the outer body 50 and the remainder of the lower portion 22*b* of the release tool 22.

Four of the collet engagement members 46 and four of the lobes 66 are depicted in FIG. 3. However, in other examples, any number of engagement members and lobes may be used.

It may now be fully appreciated that the above disclosure provides significant advancements to the art of designing, constructing and operating well tools which are capable of reliably and conveniently disconnecting upper and lower sections of a bottom hole assembly. In one example described above, the release tool includes an electrical motor assembly that displaces an inner mandrel to release upper and lower portions of the release tool from each other.

The inner mandrel may have a series of circumferentially spaced apart lobes formed thereon which are initially radially aligned with engagement members formed on a collet sub. The lobes may radially outwardly support the engagement members in engagement with a profile formed in an outer body of the lower portion of the release tool.

The lobes, when rotated by the electrical motor assembly, may no longer be radially aligned with the engagement members. The lobes, when rotated by the electrical motor assembly, may no longer radially outwardly support the engagement members in engagement with the profile formed in the outer body of the lower portion of the release tool.

An electrical conductor may extend through an inner passage formed in the inner mandrel. The inner passage may be isolated from well fluids and pressures by seals on each opposite end of the inner mandrel.

The above disclosure provides to the art a release tool 22 for use in a subterranean well. In one example, the release tool 22 can include an inner mandrel 52, an electric motor assembly 54, and at least one engagement member 46. The inner mandrel 52 is displaceable by the electric motor assembly 54 between a first position (see FIG. 2B) in which the inner mandrel 52 supports the at least one engagement member 46 and prevents separation of first and second portions 22*a,b* of the release tool 22, and a second position (see FIG. 3) in which the at least one engagement member 46 is not supported by the inner mandrel 52 and separation of the first and second portions 22*a,b* of the release tool 22 is permitted.

The electric motor assembly 54 may be configured to rotate the inner mandrel 52 between the first and second positions. In other examples, the electric motor assembly 54 may be configured to longitudinally displace the inner mandrel 52 between the first and second positions.

The "at least one" engagement member 46 may include multiple circumferentially distributed engagement members 46. The engagement members 46 may be formed on respective ones of multiple flexible collets 44.

The inner mandrel 52 may include multiple circumferentially distributed lobes 66 that radially outwardly support respective ones of the multiple circumferentially distributed engagement members 46. The lobes 66 may be radially aligned with the respective ones of the engagement members 46 in the first position of the inner mandrel 52.

In the first position, the inner mandrel 52 may support the engagement member 46 in engagement with a profile 48 formed in an outer body 50 of the release tool 22. The second portion 22*b* of the release tool 22 may include the outer body 50.

The release tool 22 may include an electrical conductor 42 extending through an inner passage 58 formed longitudinally through the inner mandrel 52, and seals 60 at opposite ends of the inner mandrel 52. The seals 60 may isolate the inner passage 58 from fluid communication with an exterior of the release tool 22.

Also provided to the art by the above disclosure is a method of separating first and second portions 22*a,b* of a release tool 22 in a subterranean well. In one example, the method can include transmitting an electrical signal to an electrical motor assembly 54 of the release tool 22; displacing an inner mandrel 52 of the release tool 22 in response to the transmitting; and separating the first and second portions 22*a,b* of the release tool 22 after the displacing step.

The displacing step may include rotating the inner mandrel 52.

The displacing step may include displacing the inner mandrel 52 from a first position in which the inner mandrel 52 supports at least one engagement member 46 of the release tool 22 to a second position in which the inner mandrel 52 does not support the at least one engagement member 46. The displacing step may include the electrical motor assembly 54 rotating the inner mandrel 22 from the first position to the second position.

The "at least one" engagement member 46 may include multiple circumferentially spaced apart engagement members 46, the inner mandrel 52 may include multiple circumferentially spaced apart lobes 66, in the first position the lobes 66 are radially aligned with respective ones of the engagement members 46, and in the second position the lobes 66 are not radially aligned with the respective ones of the engagement members 46.

The transmitting step may include transmitting the electrical signal via an electrical conductor 42 in an inner passage 58 of the inner mandrel 52. The method may include positioning seals 60 at opposite ends of the inner mandrel 52, thereby isolating the inner passage 58 from fluid communication with an exterior of the release tool 22.

The method may include connecting the release tool 22 between a perforator 18 and an instrument carrier 24. The method may include connecting the release tool 22 in a bottom hole assembly 12 conveyed by a conveyance 16 in the well.

The first portion 22*a* of the release tool 22 may include a collet sub 38, the engagement member 46 may be formed on a collet 44 of the collet sub 38, and the second portion 22*b* of the release tool 22 may include the inner mandrel 52 and the electrical motor assembly 54. The separating step may include separating the collet sub 38 from the inner mandrel 52 and the electrical motor assembly 54 in the well.

Although the example described above includes a certain combination of features, it should be understood that it is not necessary for all features of the example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A release tool for use in a subterranean well, the release tool comprising:

an inner mandrel;

an electric motor assembly; and at least one engagement member, in which the inner mandrel is displaceable by the electric motor assembly between a first position in which the inner mandrel supports the at least one engagement member and prevents separation of first and second portions of the release tool, and a second position in which the at least one engagement member is not supported by the inner mandrel and separation of the first and second portions of the release tool is permitted, and in which the electric motor assembly is configured to rotate the inner mandrel between the first and second positions.

2. The release tool of claim 1, in which the at least one engagement member comprises multiple circumferentially distributed engagement members.

3. The release tool of claim 2, in which the inner mandrel comprises multiple circumferentially distributed lobes that radially outwardly support respective ones of the multiple circumferentially distributed engagement members.

4. The release tool of claim 3, in which the lobes are radially aligned with the respective ones of the engagement members in the first position of the inner mandrel.

5. The release tool of claim 2, in which the engagement members are formed on respective ones of multiple flexible collets.

6. The release tool of claim 1 in which, in the first position, the inner mandrel supports the at least one engagement member in engagement with a profile formed in an outer body of the release tool.

7. The release tool of claim 6, in which the second portion of the release tool comprises the outer body.

8. The release tool of claim 1, further comprising an electrical conductor extending through an inner passage formed longitudinally through the inner mandrel, and seals at opposite ends of the inner mandrel.

9. The release tool of claim 8, in which the seals isolate the inner passage from fluid communication with an exterior of the release tool.

10. A method of separating first and second portions of a release tool in a subterranean well, the method comprising:

transmitting an electrical signal to an electrical motor assembly of the release tool;

displacing an inner mandrel of the release tool in response to the transmitting, in which the displacing comprises rotating the inner mandrel; and separating the first and second portions of the release tool after the displacing.

11. The method of claim 10, in which the displacing comprises displacing the inner mandrel from a first position in which the inner mandrel supports at least one engagement member of the release tool to a second position in which the inner mandrel does not support the at least one engagement member.

12. The method of claim 11, in which the displacing comprises the electrical motor assembly rotating the inner mandrel from the first position to the second position.

13. The method of claim 11, in which the at least one engagement member comprises multiple circumferentially spaced apart engagement members, the inner mandrel comprises multiple circumferentially spaced apart lobes, in the first position the lobes are radially aligned with respective ones of the engagement members, and in the second position the lobes are not radially aligned with the respective ones of the engagement members.

14. The method of claim 10, in which the transmitting comprises transmitting the electrical signal via an electrical conductor in an inner passage of the inner mandrel.

15. The method of claim 14, further comprising positioning seals at opposite ends of the inner mandrel, thereby isolating the inner passage from fluid communication with an exterior of the release tool.

16. The method of claim 10, further comprising connecting the release tool between a perforator and an instrument carrier.

17. The method of claim 10, further comprising connecting the release tool in a bottom hole assembly conveyed by a conveyance in the well.

18. The method of claim 10, in which the first portion of the release tool comprises a collet sub, in which an engagement member is formed on a collet of the collet sub, and in which the second portion of the release tool comprises the inner mandrel and the electrical motor assembly, whereby the separating comprises separating the collet sub from the inner mandrel and the electrical motor assembly in the well.

* * * * *